United States Patent [19]

Fedak

[11] Patent Number: 4,579,232

[45] Date of Patent: Apr. 1, 1986

[54] VERSATILE DISPLAY RACK

[75] Inventor: Charles J. Fedak, East Brunswick, N.J.

[73] Assignee: MacMillan Bloedel Containers, Atlanta, Ga.

[21] Appl. No.: 490,990

[22] Filed: May 2, 1983

[51] Int. Cl.[4] ..... A47F 7/00

[52] U.S. Cl. ..... 211/50; 211/132; 206/44 R; 206/45.25

[58] Field of Search ..... 211/13, 50, 73, 72, 211/50, 132, 42, 88, 126; 248/174, 126; 206/44 R, 45.24, 45.25, 45.26

[56] References Cited

U.S. PATENT DOCUMENTS

| | | | |
|---|---|---|---|
| 1,189,531 | 7/1916 | Bierwirth | 206/45.24 |
| 1,315,326 | 9/1919 | Palis | 248/126 X |
| 1,515,741 | 11/1924 | Lyons | 206/45.24 |
| 1,909,473 | 5/1933 | Keppler | 206/44 R |
| 1,997,310 | 4/1935 | Roege . | |
| 2,447,128 | 8/1948 | Logan . | |
| 2,765,906 | 10/1956 | Rossum . | |
| 3,494,479 | 2/1970 | Martin | 248/174 X |
| 3,724,799 | 4/1973 | Dotson | 211/13 X |
| 3,802,657 | 4/1974 | Jackson . | |
| 3,995,744 | 12/1976 | Metcalf . | |
| 4,116,330 | 9/1978 | Ellis . | |

FOREIGN PATENT DOCUMENTS

| | | | |
|---|---|---|---|
| 321309 | 11/1929 | United Kingdom | 206/44 R |

*Primary Examiner*—Ramon S. Britts
*Assistant Examiner*—Sarah A. Lechok Eley
*Attorney, Agent, or Firm*—Beveridge, DeGrandi & Weilacher

[57] ABSTRACT

A rack for the display of magazines and the like on a horizontal surface or alternatively on a pair of vertically spaced-apart horizontal rails includes a container having a back wall, a floor, right and left sidewalls and front margin portions adjacent the floor and sides, a strut member adapted for extension rearward and downward from the back wall and a brace member adapted for extension rearward from the back wall to engage the strut member at a location spaced from the back wall to secure the strut member at an acute angle to the back wall for support of the container on a horizontal surface as an easel, and a flap extending rearward from the back wall for interengagement with a pair of vertically spaced-apart horizontal rails, whereby the container can selectively be displayed on the horizontal surface or on the rails.

13 Claims, 7 Drawing Figures

VERSATILE DISPLAY RACK

BACKGROUND OF THE INVENTION

The present invention relates to display racks for use in stores. The rack is particularly well-suited for the display and merchandising of magazines and other articles of similar shape.

Point of sale displays at checkout counters of grocery stores, drug stores, and the like have been found to be particularly effective in inducing sales. Accordingly, to the extent that a magazine publisher can convince retailers to provide his magazines for sale in a conspicuous location such as on a checkout counter or in adjacent display racks, the publisher will increase the likelihood of sales of his magazines by the retailer. But display space in retail stores is often scarce, and retailers prefer to use such space as efficiently as possible. The space can take many forms, including counter space, display rack space and the like. As a result it is important to publishers to be able to provide to retailers a merchandising package for the magazines which can be put to use according to the retailer's available display space.

It is known to provide countertop display racks for merchandise, such as shown by U.S. Pat. Nos. 1,997,310 to Roege; 2,765,906 to Rossom and 4,116,330 to Ellis. It is also known to provide display racks which can be hung from two vertically spaced-apart horizontal rails, as shown by U.S. Pat. No. 3,995,744 to Metcalf. However, heretofore such display racks were committed to use as displays either on countertops or on horizontal rails and were not interchangeable.

Accordingly, there is a need in the art for an inexpensive, reliable, attractive and versatile rack for displaying magazines or the like on a countertop or on a pair of vertically spaced-apart horizontal rails.

SUMMARY OF THE INVENTION

The present invention fulfills this need by providing a rack for the display of magazines and the like on a horizontal surface or alternatively on a pair of vertically spaced-apart horizontal rails. The rack includes a container for the magazine, the container having a back wall, a floor, right and left sidewalls and front margin portions adjacent the floor and sidewalls. A strut member is adapted to be extended rearward and downward from the back wall, and a brace member is adapted to be extended rearward from the back wall to engage the strut member at a location spaced from the back wall to secure the strut member at an acute angle to the back wall for support of the container on a horizontal surface as an easel. A flap extends rearward from the back wall for interengagement with a pair of vertically spaced-apart horizontal rails. Thus the container and magazines or the like held therein can selectively be displayed on the horizontal surface or on the rails.

The invention includes a blank of relatively rigid, but foldable, sheet material, such as corrugated cardboard, which can be set up to form the rack. The back wall has inner and outer layers, and the flap is broken out of the inner layer and extends through a slot in the outer layer. The strut member is broken out of one of the inner and outer layers, and the brace member is broken out of the other layer. Preferably, the strut member is broken out of the outer layer, and the back is broken out of the inner layer. The strut has two ends, one of which serves as a hinge to the back wall and the other of which has a protruding tab. The brace member has a slot adapted to receive the tab so that the base member engages the strut member. Preferably the back wall forms a obtuse angle with the floor.

BRIEF DESCRIPTION OF THE DRAWINGS

The invention will be better understood from a reading of the description hereinafter along with a study of the drawings wherein.

DETAILED DESCRIPTION OF A PREFERRED EMBODIMENT

Figure 1:
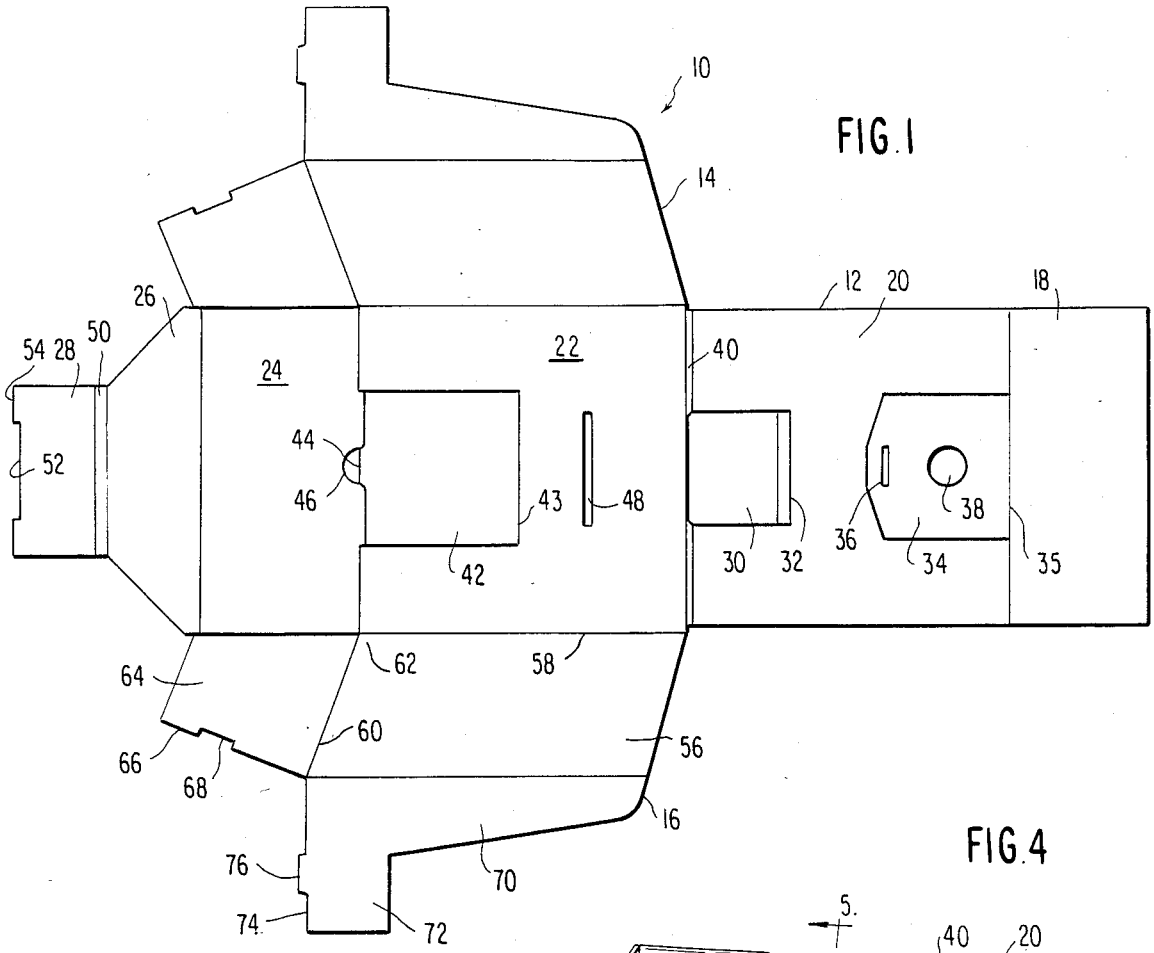
FIG. 1 is a top view of a cut-out and scored blank which can be set up into a display rack for magazines.

As shown in FIG. 1, the preferred rack for the display of magazines can be made out of a single blank 10 cut to the appropriate shape and provided with score lines and cut outs. The rack can be set up by folding the blank along the score lines into the desired shape. The blank can be of any suitable bendable and foldable, but relatively rigid, sheet material. Suitable materials include solid fiberboard, chip board, cardboard, extruded materials, and the like. In a presently preferred embodiment, the blank is cut out of corrugated "B" flute cardboard. Suitable cardboards are from about 1/16 to about ¼ inch thick.

The blank in FIG. 1 includes a central portion 12, a right side assembly 14 and a left side assembly 16. The central portion 12 has a longitudinal axis and is made up of a sequence of smaller sections. These include an inner floor section 18, an inner back wall section 20, an outer back wall section 22, an outer floor section 24, an outer lower front margin section 26 and an inner lower front margin section 28.

The inner back wall section 20 has two flaps formed from it. A hanger flap 30 is cut out along three sides, but its fourth side 32 is left intact so that the hanger flap 30 is hinged to the remainder of inner back wall section 20. A brace flap 34 is likewise cut out around three sides, but its fourth side 35 remains intact to form a hinge along the scoreline between the inner back wall section 20 and the inner floor section 18. Brace flap 34 has a slot 36 and a finger hole 38 cut out of it. The inner back wall section 20 and the outer back wall section 22 are separated by a small top section 40, wide enough only to allow the two sections of sheet material to be folded neatly against each other.

The outer back wall section 22 has a strut flap 42 cut out along three sides, with a fourth side 43 intact to serve as a hinge connection to the remainder of outer back wall section 22. The flap 42 has a peripheral tab 44 on its free end. When the blank lies flat, the peripheral tab 44 protrudes into a finger hole 46 cut in the outer floor section 24. A slot 48 is cut out of outer back wall section 22 transverse to the longitudinal axis of the central portion 12. Slot 48 is of a size and position to receive the hanger flap 30 when the two back wall sections are folded together.

The width of the sections 18, 20, 22 and 24 is slightly in excess of the expected width of the magazines or other product to be displayed in the rack. The outer lower front margin section 26 tapers in width from the width of the floor section 24 to some lesser dimension, preferably about one-half of the width of the magazines to be displayed. A front top section 50, similar to the back top section 40, separates the outer and inner lower front margin sections 26 and 28. The inner lower front margin section 28 has a floor-abutting edge 52 from which protrude a pair of spaced-apart tabs 54.

The right side assembly 14 and left side assembly 16 are substantially mirror images of one another, so a description of one should suffice as a description of the other. The left side assembly 16 includes a left sidewall section 56 joined along line 58 to the outer back wall section 22. The left side assembly 16 is a non-right parallelogram. A partial intermediate floor section 64 is joined along lower edge 60 to the left side wall section 56, but is separated from the outer floor section 24. The line 58 and the lower edge 60 of the left sidewall section form an angle 62. Angle 62 is preferably obtuse. The partial intermediate floor section 64 has a lateral edge 66 from which a cut out portion 68 has been taken.

A lateral front margin section 70 is joined to the left sidewall section 56 and has a partial intermediate lower front margin section 72 protruding from it. The partial intermediate lower front margin section 72 has a floor abutting edge 74 from which protrudes a tab 76.

Figure 4:
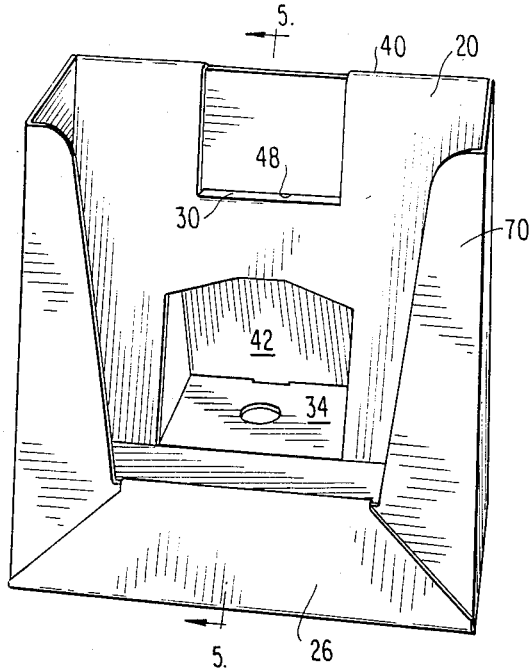
FIG. 4 is a perspective view from the front of the rack as set up and used as an easel display.
Figure 2:
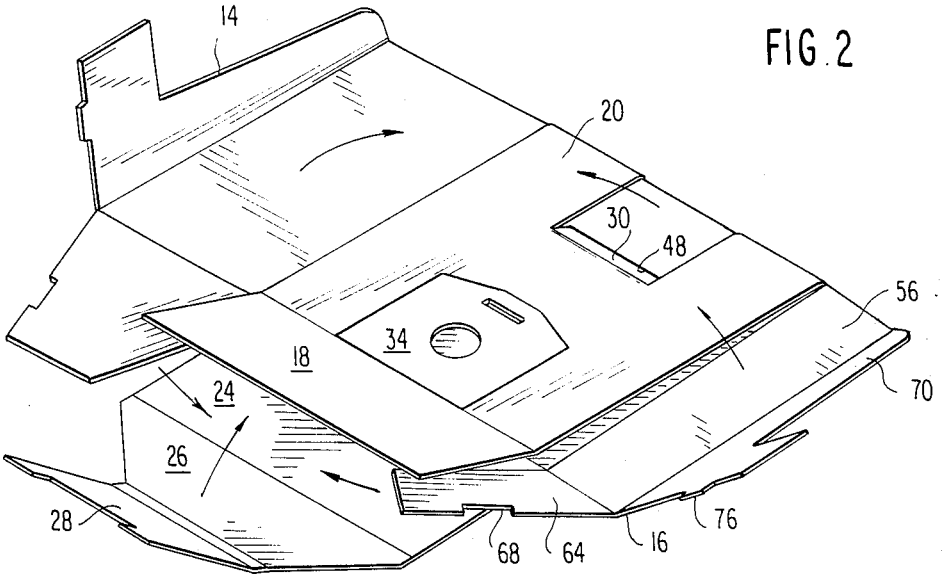
FIG. 2 is a perspective view of an early step in the set up of the blank of FIG. 1 into the finished rack.
Figure 5:
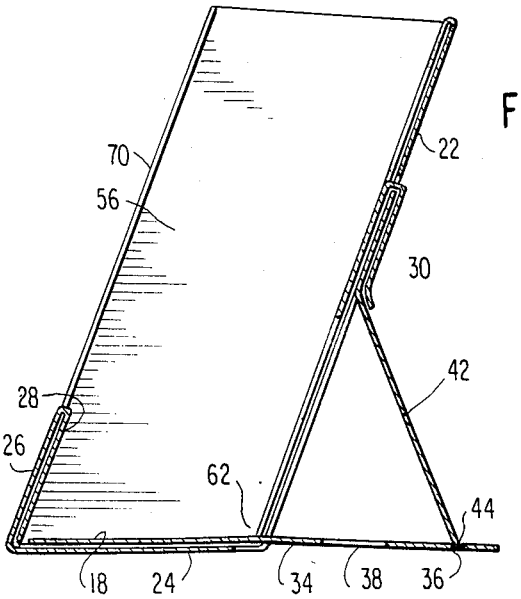
FIG. 5 is a sectional view of the set up rack as shown in FIG. 4, taken along lines 5—5.
Figure 3:
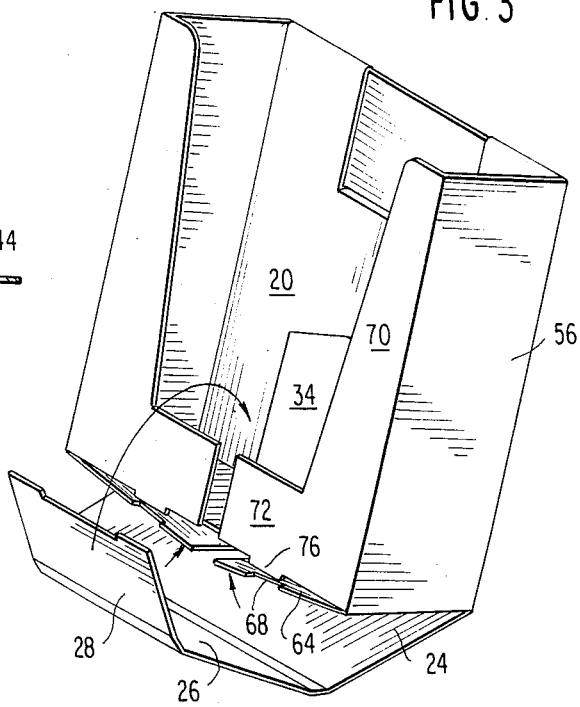
FIG. 3 is a perspective view of a later step in the set up of the rack.
Figure 6:
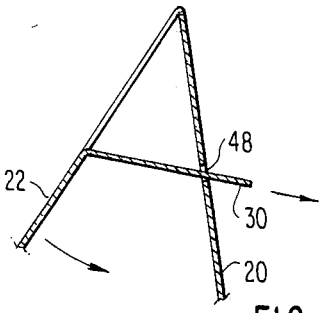
FIG. 6 is a sectional view taken along lines 6—6 of FIG. 2 showing the relationship of the components depicted during set up.

It is from the blank 10 that the rack shown in perspective in FIG. 4 is formed by a process depicted in FIGS. 2, 3 and 6. As shown in FIG. 2, the inner back wall section 20 is folded onto outer back wall section 22. As they are being folded together, the hanger flap 30 is broken out of inner back wall section 20 and inserted through slot 48 in outer back wall section 22, as shown in FIG. 6. When the two back wall sections have been brought into contact with one another, the inner floor section 18 is folded up out of the plane of inner back wall section 20, as shown in FIG. 2.

The sidewall assemblies are then folded up, out of the plane of outer back wall section 22. Thus, the left side assembly 16 is folded up along line 58. At the same time, the partial intermediate floor section 64 is folded up with respect to the left sidewall section 56. The lateral front margin section 70, together with the partial intermediate lower front margin section 72 is folded up with respect to left sidewall section 56. These sections are folded so that the tab 76 on the partial intermediate lower front margin section 72 fits into the cut out portion 68 of the lateral edge 66 of partial intermediate floor section 64. Similar folding steps are taken with respect to the right side assembly 14. As a result, the side assemblies are wrapped around to form the sides and the inside sections of the bottom and front margins of the rack, as shown in FIG. 3.

The outer floor section 24 is brought up under the partial intermediate floor sections 64, and the outer lower front margin section 26 is positioned in front of the partial intermediate lower front margin sections 72. The inner lower front margin section 28 is then swung behind the partial intermediate lower front margin sections 72. Each tab 54 fits in one of the cut out portions 68 to lock the inner lower front margin section 28 in position. The back wall, sidewalls, front margin portions and floor thus make up a container.

The container is then filled with magazines and shipped to a retailer for display. The retailer can assemble the display as a counter easel by breaking strut flap 42 out of the outer back wall section 22 and breaking brace flap 34 out of the inner back wall section 20. The finger holes 38 and 46 facilitate this process, even when the container is full of magazines. The easel can be leaned backward onto strut flap 42, with flap 42 held in place by inserting its tab 44 into slot 36 in brace flap 34. The brace flap serves as a flat foundation on which the strut flap can be braced.

Figure 7:
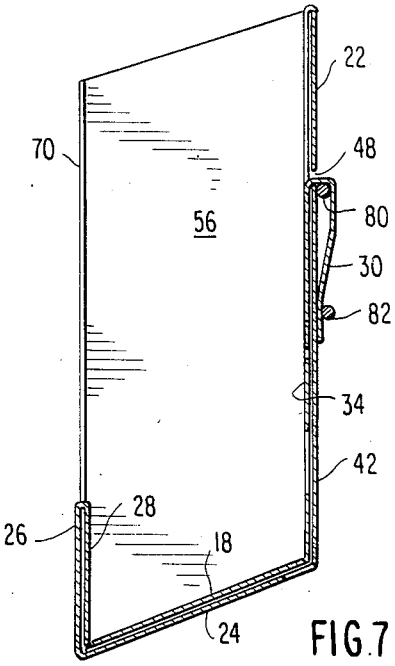
FIG. 7 is a sectional view similar to FIG. 5, in which the rack has been mounted on a pair of vertically space-apart horizontal rails.

Alternatively, if the retailer wishes to display the magazines on a pair of vertically spaced-apart horizontal rails, he may leave the flaps 34 and 42 in position contiguous with the inner and outer back wall sections and employ only the hanger flap 30. This type of assembly is shown in FIG. 7, in which the hanger flap 30 is extended over the top of an upper rail 80 and then down between a lower rail 82 and the outer back wall section 22 where it will be held in position by friction. Thus, the flap 30 is interengaged with rails 80 and 82. The weight of the magazines in the rack urge the flap against the lower rail hold the rack in place.

When hung, the display has a floor sloping towards the front so that as individual items from the container are purchased, the remaining items slide forward for display at the front of the rack. This is facilitated by making the angle 62 obtuse. Preferably the angle 62 is about 110°.

If desired, a slot can be provided in the strut flap 42 to receive and confine the hanger flap 30 when the display is used as a counter display.

As will be apparent, other modifications and variations on the specific disclosure hereof can be made without departing from the spirit and scope of the invention.

What is claimed is:

1. A rack made from a single blank for the display of magazines and the like on a horizonatal surface comprising:

a container having an inner back wall and an outer back wall, an inner floor and an outer floor, right and left sidewalls and an outer lower front margin section and an inner lower front margin section, said sections being adjacent said floor, and a right lateral front section and a left lateral front section, said floor and back wall being of a width approximately equal to the magazine width, said right and left sidewalls extending from said back wall and being substantially mirror images of one another, and said lateral front margin sections extending from the respective side wall;

a strut member adapted for extension rearward and downward from said back wall and being a part of said outer back wall and a brace member adapted for extension rearward from said back wall to engage said strut member at a location spaced from said back wall to secure said strut member at an acute angle to said back wall for support of said container on a horizontal surface as an easel, said brace member being a part of said inner back wall and being connected with said inner floor;

whereby said rack can selectively be displayed on a horizontal surface.

2. A rack as claimed in claim 1 wherein said strut member is broken out of said outer back wall, and said brace member is broken out of said inner back wall.

3. A rack as claimed in claim 1 made of corrugated cardboard.

4. A rack as claimed in claim 1 wherein said back wall forms an obtuse angle with said floor.

5. A rack as claimed in claim 1 wherein said strut member has two ends, one being hinged to said back wall and the other having a protruding tab, and said brace member has a slot adapted to receive said protruding tab whereby said brace member engages said strut member.

6. A blank of relatively rigid but foldable sheet material adapted to be set up to form a rack for the display of magzines of a given width on a horizontal surface or alternatively on a pair of vertically spaced-apart horizontal rails comprising:

a central portion which has a longitudinal axis, said central portion including in sequence from one end thereof to the other end thereof an inner floor section, an inner back wall section, an outer back wall section, an outer floor section, an outer lower front margin section and an inner lower front margin section, each of said floor sections and back wall sections of a width approximately equal to the magazine width, said inner lower front margin section having substantially parallel sides of a lesser width than the magazine width; and right and left side assemblies extending laterally from said outer back wall section and being substantially mirror images of one another, each said side assembly including a side wall section, a lateral front margin section extending laterally of its respective side wall section, and a partial intermediate floor section extending logitudinally from its respective sidewall section, said lateral front margin section having a partial intermdediate lower front margin section extending laterally therefrom;

said outer back wall section having a slot therein transverse to said axis, and said inner back wall section having a flap broken out thereof for insertion through said slot upon set up of the rack;

said outer back wall section having a strut member broken out thereof, and said inner back wall section having a brace member broken out thereof for engagement with and securement of said strut member upon set up of the rack, each of said sections being separated from one another by score lines which permit said blank to be folded to form the rack.

7. A blank as claimed in claim 6 wherein said side wall sections are non-right parallelograms, whereby upon set up of the rack, said floor sections form an obtuse angle with said back wall section.

8. A blank as claimed in claim 6 wherein said strut member has a peripheral tab, and said brace member has a slot adapted for receiving said tab upon set up of said rack.

9. A blank as claimed in claim 6 wherein said partial intermediate floor sections have lateral edges with portions cut out therefrom, and said partial intermediate lower front margin sections and said inner lower front margin section have floor abutting edges with tabs protruding therefrom for insertion in said cut out portions upon set up of the rack.

10. A blank as claimed in claim 6 wherein said outer lower front margin section has lateral edges tapering from said magazine width to the width of said inner lower front margin section.

11. A rack for the display of magazines and the like on a pair of vertically spaced-apart horizontal rails comprising:

a container having an inner back wall and an outer back wall, an inner floor and an outer floor, right and left sidewalls and an outer lower front margin section and an inner lower front margin section, said sections being adjacent said floor and a right lateral front section and a left lateral front section, said floor and back wall being of a width approximately equal to the magazine width;

said right and left sidewalls extending from said back wall and being substantially mirror images of one another, and said lateral front margin sections extending from the respective sidewall;

said outer back wall having a horizontal slot therein and said inner back wall having a flap broken out thereof and inserted through said slot;

said flap extending rearward from said back wall for engagement with a pair of vertically spaced-apart horizontal rails;

whereby said rack may be displayed on said rails.

12. A rack as claimed in claim 11, wherein said flap is broken out of said inner layer and extends through a slot in said outer layer.

13. A rack as claimed in claim 11 made of corrugated cardboard.

* * * * *